US012687304B2

(12) United States Patent
Leikam et al.

(10) Patent No.: US 12,687,304 B2
(45) Date of Patent: Jul. 21, 2026

(54) COMBINATION APPLIANCE COMPRISING A COOKING HOB AND AN EXTRACTION DEVICE

(71) Applicant: ELECTROLUX APPLIANCES AKTIEBOLAG, Stockholm (SE)

(72) Inventors: Juergen Leikam, Rothenburg ob der Tauber (DE); Alwin Neukamm, Rothenburg ob der Tauber (DE); Marco Russo, Porcia (IT); Felicitas Fust, Nuremberg (DE); Eduardo Puoti, Rothenburg ob der Tauber (DE); Ugo Lo Conte, Forli (IT); Peter Negretti, Forli (IT); Christian Mohr, Nuremberg (DE); Rosolino Rezzola, Forli (IT); Fabio Spanó, Forli (IT); Steffie Lim, Nuremberg (DE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 526 days.

(21) Appl. No.: 18/019,018

(22) PCT Filed: Jul. 27, 2021

(86) PCT No.: PCT/EP2021/071070
§ 371 (c)(1),
(2) Date: Jan. 31, 2023

(87) PCT Pub. No.: WO2022/028968
PCT Pub. Date: Feb. 10, 2022

(65) Prior Publication Data

US 2023/0213209 A1 Jul. 6, 2023

(30) Foreign Application Priority Data

Aug. 5, 2020 (EP) ..... 20189683

(51) Int. Cl.
*F24C 15/20* (2006.01)
*F24C 15/14* (2006.01)

(52) U.S. Cl.
CPC ..... *F24C 15/2042* (2013.01); *F24C 15/14* (2013.01); *F24C 15/2035* (2013.01)

(58) Field of Classification Search
CPC ... F24C 15/2042; F24C 15/14; F24C 15/2035
(Continued)

(56) References Cited

U.S. PATENT DOCUMENTS 6,455,818 B1 9/2002 Arntz et al.
2004/0107956 A1* 6/2004 Lee ..... F24C 15/2035 126/299 R
(Continued)

FOREIGN PATENT DOCUMENTS

CN 202188541 4/2012
CN 109416187 3/2019
(Continued)

OTHER PUBLICATIONS

Machine Translation of EP 3290813 (Year: 2018).*
(Continued)

*Primary Examiner* — Allen R. B. Schult
*Assistant Examiner* — Amy E Carter
(74) *Attorney, Agent, or Firm* — Chrisman Gallo Tochtrop LLC

(57) ABSTRACT

The present invention is related to a combination appliance (10) comprising a cooking hob (12) and an extraction device (14). The cooking hob (12) comprises at least one cover plate or worktop (22) having an opening (24) or a recess formed therein. The extraction device (14) is arranged below the cover plate or worktop (22) and comprises at least one fan (36) for sucking air from the area above the cooking hob (12) through the opening (24) or recess of the cover plate or
(Continued)

worktop (22). The extraction device (14) further includes at least one filter carrier (50) and at least one filter (52; 52*a*, 52*b*), which is removable through the opening (24) or recess. According to the invention, the extraction device (14) comprises at least one liquid collector (28*a*, 62, 74, 76, 76') and a lid or grid (26), which is inserted in the opening (24) or recess. The at least one liquid collector (62) is preferably removable through the opening (24) or recess of the cover plate or worktop (22) and/or may comprise at least one overflow opening (68).

14 Claims, 8 Drawing Sheets

(58) Field of Classification Search
USPC ..... 126/299 D
See application file for complete search history.

(56) References Cited

U.S. PATENT DOCUMENTS

| | | | | |
|---|---|---|---|---|
| 2006/0150965 | A1* | 7/2006 | Kim | F24C 15/2042 126/299 D |
| 2020/0094180 | A1* | 3/2020 | Adam | F24C 15/32 |
| 2021/0055002 | A1* | 2/2021 | Chartrel | F24C 15/2042 |
| 2022/0178552 | A1* | 6/2022 | Flesch | F24C 15/2035 |

FOREIGN PATENT DOCUMENTS

| | | | | |
|---|---|---|---|---|
| CN | 110160102 | | 8/2019 | |
| DE | 202009008286 | | 9/2009 | |
| DE | 202009008286 | U1 * | 9/2009 | F24C 15/2042 |
| DE | 202016003254 | | 6/2016 | |
| DE | 202016104283 | | 8/2016 | |
| DE | 102016123418 | A1 * | 6/2018 | F24C 15/2042 |
| DE | 102017217853 | | 4/2019 | |
| DE | 102018212329 | A1 | 1/2020 | |
| DE | 102018213743 | | 2/2020 | |
| EP | 3133349 | | 2/2017 | |
| EP | 3287701 | A1 | 2/2018 | |
| EP | 3290813 | | 3/2018 | |
| EP | 3290813 | A1 * | 3/2018 | F24C 15/2042 |
| EP | 3916308 | A1 * | 12/2021 | F24C 15/2035 |
| JP | H058307 | U * | 2/1993 | |
| KR | 101586379 | | 1/2016 | |
| WO | 2019081271 | A1 | 5/2019 | |
| WO | 2019166249 | | 9/2019 | |

OTHER PUBLICATIONS

DE 102016123418 with Machine Translation (Year: 2018).*
JP H058307 with Machine Translation (Year: 1993).*
Machine Translation of DE 202009008286 (Year: 2009).*
International Search Report and Written Opinion for PCT/EP2021/071070, dated Sep. 24, 2021, 9 pages.
European Communication for application No. 20189683.4, dated Nov. 18, 2024, 19 pages.
European Communication for application No. 20189683.4 dated Jun. 30, 2025, 14 pages.
Chinese Office action for application No. 202180050042.4, dated Aug. 9, 2025, 9 pages.
Australian Examination Report for corresponding Application No. 2020462732, issued May 2, 2026.
Australian Examination Report for corresponding Application No. 2020461587, issued May 4, 2026.

* cited by examiner

COMBINATION APPLIANCE COMPRISING A COOKING HOB AND AN EXTRACTION DEVICE

The present invention relates to a combination appliance comprising a cooking hob and an extraction device.

During the performance of cooking activities under use of a cooking hob, kitchen vapours are generated, which are distributed over the cooking area. In order to avoid these kitchen vapours to be spread throughout the entire kitchen space, an arrangement of an extraction device, particularly an extractor hood, is common. Said extraction device is operated in parallel to the cooking hob, thereby sucking in those kitchen vapours in order to filter out particles and tiny droplets from the vapours and/or to blow the vapours to the outside of the building. While it has been common to arrange such an extractor hood above the cooking area, in recent years downdraft extraction devices have been finding a growing market. Such kind of extraction device is usually arranged below a worktop of the related cooking hob and it comprises at least one fan for sucking air from the cooking area through an opening or recess arranged in the worktop.

One specific downdraft extraction device is known from U.S. Pat. No. 6,455,818 B1. This document discloses a filter assembly for a downdraft cooking appliance arranged below an air grill leading to a venting plenum. A liner, which supports a filter of the filter assembly, is removably positioned inside the plenum. The liner is suspended from the air grill and removable in unison with the grill for inspection, cleaning or replacement. The cooking appliance disclosed in this document does not comprise any means for dealing with fluids spilling over during a cooking process, for example resulting from a boilover, and penetrating an opening of the plenum, which provides an entry to the plenum through the worktop.

It is an object of the present invention to provide a combination appliance comprising a cooking hob and an extraction device, which is designed in a way as to deal properly with liquid spillage that might occur during a cooking process on the cooking hob, preventing said liquid spillage to cause any problem in the interior of the combination appliance.

According to the present invention, a combination appliance comprises a cooking hob and an extraction device. The cooking hob includes at least one cover plate or worktop, which has an opening or a recess formed therein, particularly in or close to a central region thereof. The extraction device is arranged below the cover plate or worktop and comprises at least one fan for sucking air, in particular kitchen vapour, from the area above the cooking hob through the opening or recess of the cover plate or worktop. The extraction device also has at least one filter carrier and at least one filter. The filter may include more filter elements that are arranged downstream behind each other, for example filter elements having different filter designs for different filtering purposes. The filter may be configured to screen out any types of particles from the drawn-in air, but preferably at least a grease filter is used. Respectively, the carrier for said grease filter is a grease filter carrier. The filter is removable through the opening or recess. There may be a need to remove the filter from time to time for cleaning purposes, i.e. to remove particles from the filter surface filtered out of the drawn-in air, particularly in order to wash the filter and, if applicable, the filter carrier in a dishwasher. If the filter may be worn or if a disposable filter may be used, the removed filter may be replaced by a new one. According to the present invention, the extraction device comprises at least one liquid collector and a lid or grid, which is inserted in the opening or recess. Said liquid collector is provided for receiving any moisture that enters the interior of the combination appliance through the opening or recess in the cover plate or worktop, specifically it collects the spilled liquids occurring during cooking.

The lid may be a cover element covering the opening or recess at least during the non-activated state of at least the extraction device in order to prevent articles or particles from falling into the opening or the recess. The lid may be arranged in a small distance, but in parallel to the cover plate or worktop of the cooking hob, just preventing a falling in from above, but allowing a lateral intake for the kitchen vapours. Preferably, however, the lid prevents an entire intake during the non-activated state of the extraction device and is removably or pivotably arranged at the cover plate or worktop in order to be opened during an operational phase of at least the extraction device. If a grid is used instead of such a lid or cover element for entire coverage, larger items are prevented from falling into the opening or recess, but basically tiny items or fluids may find this way. To this end, in order to prevent an uncontrolled fluid penetration into the interior of the combination appliance, the grid may comprise guiding means for a controlled guiding of the fluid towards a defined destination, notably into the liquid collector.

The cooking hob may be of any type including electric or gas cooking hobs. In particular, an induction cooking hob is a part of the combination appliance. The cooking hob may further be an autarkic cooking appliance, particularly integrated in a countertop of a kitchen furniture, or it may be part of a stove.

A top surface of the cover plate or worktop, which is accessible to a user of the combination appliance, may be used for putting cookware thereon, specifically in order to perform a cooking process. To this end, the cooking hob preferably comprises at least one heating element defining a cooking zone on the cover plate or worktop. The cover plate or worktop may be of any suitable design or material, but favourably it is made out of glass ceramics.

In order to provide an air flow for the purpose of kitchen vapour extraction, preferably at least one fan is attached to the side of the cooking hob or, respectively, of the combination appliance, and not directly below the opening or recess. The kitchen vapours approaching said fan may be channelled through a fan opening of the fan, which may be arranged facing downwards or sideways. An arrangement in the downward direction is a preferred solution, because that way spilled liquids may be even further kept from splashing into the fan opening.

The at least one liquid collector is preferably removable through the opening or recess of the cover plate or worktop, which may serve the purpose of its easy cleaning and/or emptying. A simplified removability if the liquid collector preferably results from a base area of the liquid collector, which is smaller than the base area of the opening or recess. As an alternative or in addition to such kind of slightly conical design, the liquid collector may be made of an elastic or flexible material. Preferably, the liquid collector is adapted to collect an amount of up to one litre, preferably up to 0.7 litre, of fluids, particularly spilled liquids.

The liquid collector may also, in addition or as an alternative to said special removability, comprise at least one overflow opening, specifically for a spillover of collected fluids at a defined area, e.g. an overflow edge. The overflow opening may be arranged in the bottom of the liquid collector. Preferably, however, the overflow opening is arranged at least on one side of the liquid collector. The overflow opening is configured to prevent an uncontrolled overflow of spilled liquids. According to a specifically preferred embodiment, two side openings, particularly at two opposing sides, of the liquid collector are defined as overflow openings. Moreover, further preferably, said two side overflow openings form also the openings for an air stream generated by the extraction device.

In particular, the at least one filter carrier is integrated or included in the at least one liquid collector. A preferred solution is characterized by a filter carrier and a liquid collector, which are made of a one-piece construction, specifically integrally formed or of a monobloc design.

The at least one filter, in particular the grease filter, may be coupled with the filter carrier. In addition or as an alternative, the filter may be arranged in the liquid collector. The filter may be arranged vertically or horizontally in the liquid collector. Preferably, the filter includes two plain filter elements, which are arranged in parallel to each other. Alternatively, the two plain filter elements are V-shaped or are arranged in a V-shaped alignment, notably in the cross-section of the filter arrangement. Preferably, said V-shape is provided by two plain filter elements that are arranged by forming an angle between 5 and 85 degrees, preferably between 20 and 70 degrees, more preferably between 30 and 60 degrees. There is no preference for a symmetrical arrangement of the filter arrangement, i.e. the two plain filters don't have to have to be identical. Rather, a design of these two filter elements may be characterized by different lengths and/or widths. Such unsymmetrical arrangement may be favourable with respect to a standardized and non-reversed reassembly. Naturally, such symmetrical arrangement is one specific solution. The V-shaped filter arrangement also has the advantage that the spilled liquid is guided to run down on at least one of the filter elements and to drop into the liquid collector, particularly in a central area of the liquid collector.

According to an embodiment, a separation element is arranged in the opening or recess of the cover plate or worktop. It separates the components of the cooking hob from the components of the extraction device. The separation element has at least two holding or support elements for holding or supporting the lid or grid.

In particular, the holding or support elements are protrusions, for example noses. The liquid collector preferably includes two or more holding or support elements. One specific solution provides two elements that are arranged on the short sides of the separation element, and four elements that are integrated in the separation element, particularly in a symmetric arrangement. Said integration of the holding or support elements in the separation element may mean a design as a one-piece element. The lid or grid may be uncoupled from the liquid collector and/or the filter carrier. Rather, the lid or grid may just rest on the separation element. The holding or support elements of the separation element are preferably arranged at a height that results in the lid or grid to be flush-mounted in the recess or opening. This kind of insertion in the recess or opening means that the lid or grid extends at least partially in the recess or opening.

A first particularly preferred embodiment of the present invention is characterized by a first liquid collector and a second liquid collector. The second liquid collector is arranged downstream the first liquid collector providing a liquid flow from the first to the second liquid collector. It is preferably removable from the combination appliance in a movement direction away from the first liquid collector, e.g. in order to remove collected fluid that is overflowed from the first liquid collector. In particular, the second liquid collector is arranged below the first liquid collector and it may be removable from below. But more generally, there is no need for the second liquid collector to be arranged in relation to the first liquid collector by physically one above the other. Rather, the mutual arrangement of the first and second liquid collectors shall be considered in respect of the flow direction of the collected liquid. Therefore, the second liquid collector may also be arranged beside the first liquid collector. While the first liquid collector is preferably arranged beneath the opening or recess, the second liquid collector is not necessarily in the same relation to the opening or recess, but it may be e.g. in an offset arrangement thereto.

A potential solution may provide that the second liquid collector is removable through the recess, too. Preferably, however, the second liquid collector is integrated in the combination appliance, or assigned to the combination appliance, by a different approach for its removal, as will be more specified further down below. In order to provide for a particular safety element, the second liquid collector may be larger than the first liquid collector, or at least the designs of the two liquid collectors may be fleshed out in a way that the second liquid collector is adapted to collect more liquid than the first liquid collector. The second liquid collector may also be a separate canister, which is particularly configured to receive a preferably flexible pipe or hose.

Specifically, the second liquid collector is formed as a drawer, preferably arranged below the first liquid collector. Such drawer is particularly a horizontally movable or sliding element and it may be a designed to be opened with opening a kitchen or cabinet drawer that is located beneath the cooking hob. The drawer may be coupled to said kitchen or cabinet drawer, but also a solution without said coupling may be possible.

The second liquid collector may be formed also as a drip tray, which may be in a drawer design, too. But preferably the drip tray is arranged or arrangeable at or on a kitchen drawer, which is spatially positioned in relation to the combination appliance. The drip tray is particularly placed in the kitchen or cabinet drawer or directly mounted to a housing or casing of the extraction device. The drip tray may be formed to be easily taken out of the kitchen or cabinet drawer, notably after opening the kitchen or cabinet drawer.

In an embodiment, the drip tray is formed as a basin or a bowl that perfectly matches in the kitchen or cabinet drawer. Therefore, in order to guide the liquid overflowing from the first liquid collector into the second liquid collector, no pipe or channel is needed. Rather, the overflowing liquid just drips down from the first liquid collector through the overflow opening into the trip tray.

A preferred solution in relation to the drawer-shaped second liquid collector includes a locking system, which prevents the drawer from being opened during an operation of the extraction device and/or of the cooking hob. Such prevention of opening the drawer during any operation of the combination appliance may be considered as a safety factor in the operation of this appliance in order to avoid spillage and watering of the appliance interior with the risk of the fluid getting into contact with electrical components. According to an additional or alternative solution to the locking system, a sensor or switching element may be provided, which is coupled with the drawer and which causes a switch off of the extraction device and/or of the cooking hob, when the drawer not completely closed. Instead of a switch off, particularly an immediate switch-off, e.g. triggered by the sensor element, a visual and/or an acoustic signal may be provided that informs the user of the appliance in case of the drawer not being properly closed.

A particularly preferred embodiment of combination appliance according to the present invention comprises at least one sensor, which is in operative connection with the liquid collector. Said at least one sensor is particularly arranged in or at the liquid collector. The sensor may be configured for different kinds of measurement or sensing, also for sensing or monitoring more than only one parameter or condition. In particular, the at least one sensor is a liquid sensor, a dirt sensor, a weight sensor, a detection sensor and/or a fill level sensor. Preferably, the sensor is provided for detection of the presence and/or of the level or amount of liquid filling or for detection of the presence and/or of the degree of pollution inside the second liquid collector.

For example, the sensor is or comprises a reed switch or a laser sensor means. Specifically, two level sensors are included, preferably a first fill level sensor provides information to the user that the liquid collector should be emptied and a second fill level sensor gives a warning, particularly an urgent warning, to the user to immediately empty the liquid collector. A further sensor means may be a dirt sensor to collect and provide information when to clean the liquid collector. The further sensor means may be a separate sensor element or the fill level and dirt information may be detectable by a common sensor element.

One specific embodiment is characterized by a signalling means for generating a visual and/or an acoustic signal depending on a signal provided by the at least one sensor. The related information to the user of the appliance is performed by such a signal output. For example, said visual information is provided by an illumination means, which may be a blinking light element, and the acoustic signal is provided by a buzzer or beeper or a Piezo signal generator.

Another particularly preferred embodiment of the present invention provides for a liquid collector, preferably at least one of the first and second liquid collectors, which is connected or connectable to the domestic drain system. Any coupling to a domestic discharge pipe may be used for the purpose of connection; however, a connection to a siphon of a kitchen sink or of a dishwasher or a washing machine is a preferred solution. Moreover, the connection is preferably performed by a first pipe or hose. This specific embodiment makes sure that spilled liquids entering the liquid collector flow directly through this liquid collector and an overflow opening or a connecting nozzle or branch thereof to the domestic drain system. That way, the overflow opening of the liquid collector is mounted to a pipe that ends in the discharge pipe of the domestic drain system.

Advantageously, the connection to the domestic drain system is arranged in a way that a suction effect is generated downstream and/or a pressure is provided upstream the liquid to be removed from the liquid collector. This set-up may make a drain from the liquid collector more secure, notably since the spilled liquid may contain particles, which could cause a clogging of the pipe that connects the liquid collector with the domestic drain system. Advantageously, the suction effect is arranged by making use of the Venturi effect. On the other hand, said pressure on the upstream side may be effected by a pump or a compressor.

Another specific embodiment, which may be provided in combination with the solution as just described, includes a liquid collector that is connected to the domestic water supply. The convection is preferably performed by a second pipe or hose. As above, the liquid collector may be at least one of the first and second liquid collectors. Fresh water from the water supply may be used for an automatic cleaning or washing of the liquid collector, what may be initiated by pushing a button on a user interface of the combination appliance. Either the first or the second liquid collector or both liquid collectors are particularly connected to the fresh water supply. A fresh water pipe inlet is for example arranged vertically over the overflow opening of the liquid collector.

In addition or as an alternative to the cleaning or washing of the liquid collector, a sanitizing means or solution may be provided for preventing hygienic or harmful problems from a dirty liquid collector, which dirt usually comprises organic substances. In order to provide a sanitizing solution, a coupling to a sanitizing agent dispenser may be included.

At least one illumination element may be arranged in the opening or recess, preferably in or at the liquid collector. When illuminated, the illumination means provide a lighting of the liquid collector for inspection purposes and/or to sterilize the components of the extraction device, preferably the liquid collector. Both dirt accumulations deposited in the liquid collector and/or a fill level thereof can be identified or monitored. Said illumination element is preferably an LED and/or an ultraviolet light. The illumination element is particularly arranged in a way as to have a best illumination level as well as to keep the removability of the liquid collector ensured. Therefore, an arrangement of the illumination element next to, but decoupled from, the liquid collector is favourable. Preferably, the illumination element is configured to automatically switch on when the lid or grid is removed from the cover plate or worktop.

One specific embodiment is characterized by an extraction device, which comprises at least one part that includes a sound-absorbing material in order to provide a combination appliance with low sound emissions. Said at least one part may be one of: the separation element, the air channels of the extraction device, liquid collector, etc. In order to provide a sound-absorbing material, glass fiber may be used.

Favourably, at least one component of the extraction device comprises or is coated with an anti-bacterial material. That way, a sanitizing solution may be avoided and an only sporadic cleaning will nevertheless be unproblematic. For example, said coating is provided at the lid or grid, at the separation element, at the liquid collector, at the filter, particularly the grease filter, etc. Any of these components may be made out of the anti-bacterial material, rather than to be coated with a layer. The anti-bacterial material is to be understood as a material, that is toxic for organic life and therefore germicidal. This means that the anti-bacterial material has antiseptic properties. An example for an anti-bacterial material is copper, silver, enamel and functionalized sol-gel systems.

According to yet another particularly preferred embodiment of the present invention, the at least one liquid collector, particularly the second liquid collector, is made of or comprises a sponge material. Said sponge material is adapted to collect liquids overflowing from the liquid collector. The amount of resorbable liquid is specifically dependent from the volume and the resorbability of the used sponge material. The second liquid collector comprising the sponge material is preferably easily removable for cleaning and/or emptying purposes, which cleaning or emptying is usually a simple task itself. Such sponge material can be squeezed to empty and held underneath fresh water to clean it.

The present invention will be described in further detail with reference to the drawings, in which FIG. 1 is a perspective view of a combination appliance comprising a cooking hob and a downdraft extraction device installed in a kitchen cabinet;

In all figures the same or equivalent part are marked with the same reference numbers.

Figure 1:
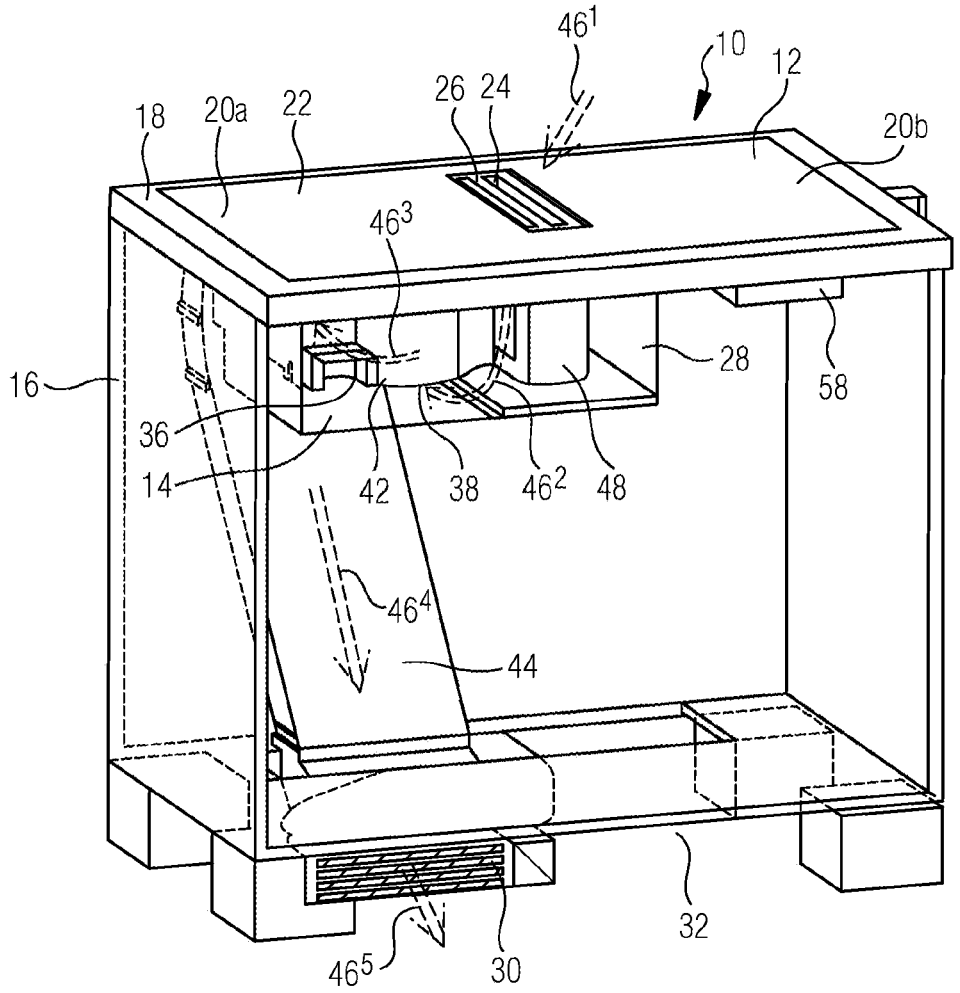

FIG. 1 illustrates a combination appliance 10 comprising a cooking hob 12 and a downdraft extraction device 14 installed in a kitchen cabinet 16. The cooking hob 12 is installed in a cutout of a kitchen countertop 18 forming a top cover plate of the kitchen cabinet 16. The downdraft extraction device 14 is configured to take away cooking vapours occurring during cooking processes, in particular when cooking with uncovered cookware. As can best be seen in FIGS. 2 and 4, the cooking hob 12 comprises cooking regions 20*a*, 20*b* arranged on a left half and a right half of a worktop 22 of the cooking hob 12, which left and right halves are separated from each other by a suction opening 24 for an intake of the cooking vapours, the suction opening 24 being arranged alongside a worktop centreline. The suction opening 24 is covered by a cover grid 26 for preventing items, e.g. cookware, to fall into the suction opening 24.

A casing 28 of the extraction device 14 is shown in FIG. 1 in transparent illustration. Said casing 28 provides a closed outer shell or first channel for a flow of the sucked-in cooking vapours on their way from the suction opening 24 to an exhaust opening 30 in a base area 32 of the kitchen cabinet 16. Said exhaust opening 30 is also covered, namely by an outlet grille 34.

The flow of the sucked-in cooking vapours through the extraction device 14 is driven by the operation of an extraction fan 36 arranged inside of the casing 28. Said extraction fan 36 comprises a bottom-sided intake opening 38 for sucking the cooking vapours from the interior space of the casing 28.

Figure 3:
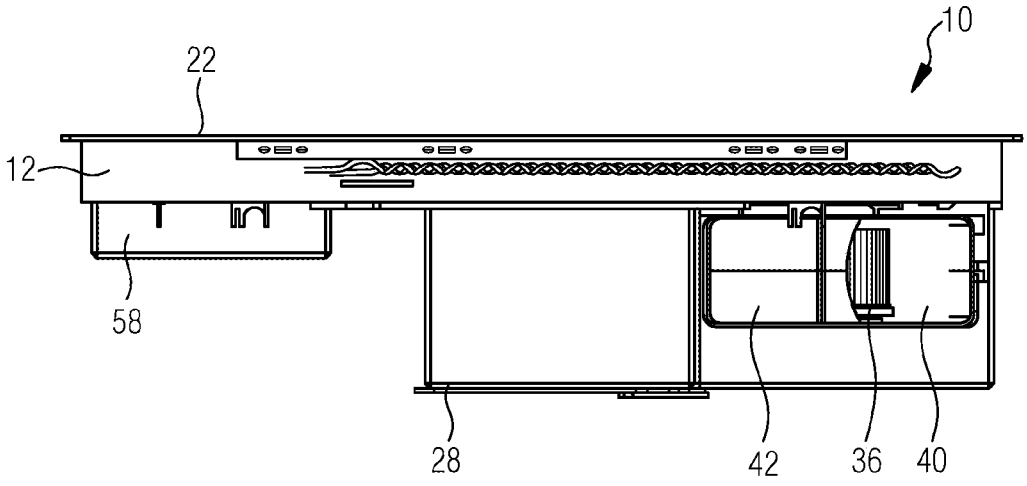
FIG. 3 is a rear view of the combination appliance of FIG. 2.

As illustrated by FIG. 3, which is a rear view of the combination appliance 10, a rear-sided fan outlet 40 is arranged for a horizontal exit of the air blown out backwards from the extraction fan housing 42. The fan outlet 40 is connected to a first end of an air duct 44 designed as a rectangular tube and forms a second channel arranged downstream the above-mentioned first channel. Directly at the passage from the fan outlet 40 to the air duct 44, an air duct bending by 90 degrees is implemented, which redirects the air flow from horizontal to vertical downwards. The air duct 44 may be guided alongside a rear side of the kitchen cabinet 16 and may be bent again by 90 degrees close to a rear lower edge of the kitchen cabinet 16 in order to direct the airflow towards exhaust opening 30 in the base area 32 of the kitchen cabinet 16. Accordingly, the second end of the air duct 44 is connected to the exhaust opening 30. The embodiment illustrated in FIG. 1 shows a solution of the air duct 44 with an inclined section of its downwardly directed portion, directed slightly to the right. Naturally, a solution with said portion arranged in an exact vertical direction is considerable as well.

The course of the cooking vapours from the cooking area through the extraction device 14 to a re-entry into room air is illustrated in FIG. 1 by dotted arrows $\mathbf{46}^1$ to $\mathbf{46}^5$. On their way through the extraction device 14, the cooking vapours pass through a filter assembly 48, which is arranged downstream directly behind the suction opening 24. Said filter assembly 48, which will be described in more detail further down below, includes a filter carrier 50 and a filter 52, in particular a grease filter, which is adapted to filter particles and droplets, in particular fat droplets, out of the cooking vapours, in that purifying the cooking vapours in order to feed filtered air back to the room air.

Figure 2:
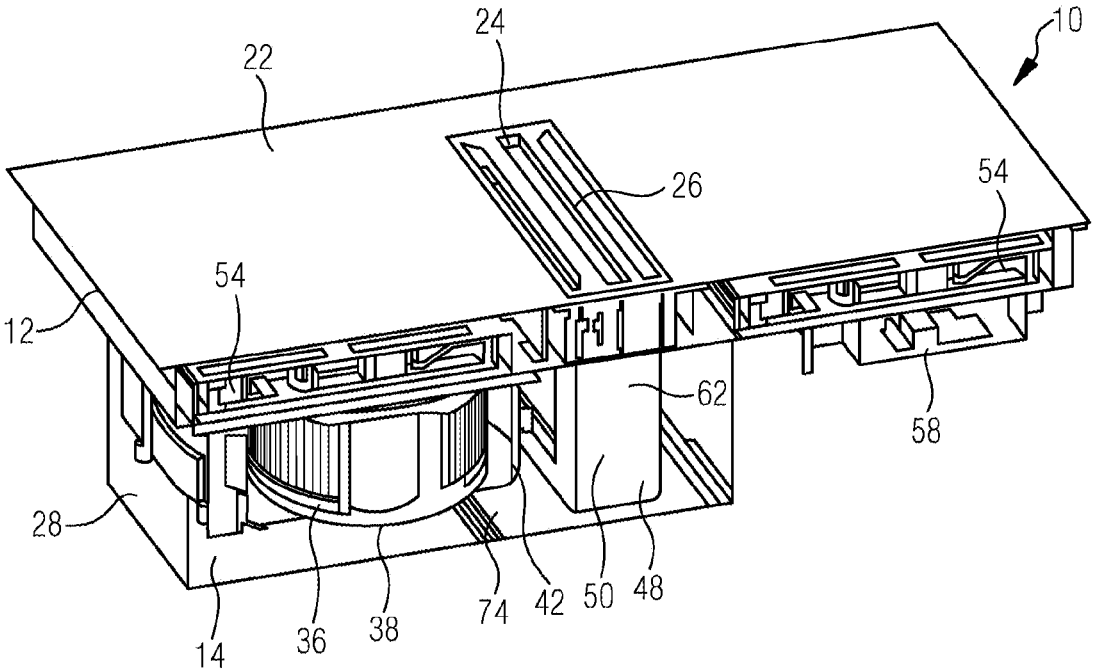
FIG. 2 is a cross-sectional perspective view of the disassembled combination appliance of FIG. 1 with a frontal surface cut away and including a first collection device and a first example of a second collection device for spilled liquids.

The cross-sectional view of FIG. 2 further shows two power boards 54, one for the left cooking region 20*a* and one for the right cooking region 20*b*, the power boards 54 providing cooking zones in the left and right cooking regions 20*a*, 20*b* with electrical power. In the present embodiment, the cooking hob 12 is an induction cooking hob and the cooking zones are defined by induction coils 56 (see particularly FIGS. 4 and 10) that are arranged below the worktop 22 of the cooking hob 12. Attached to the bottom side of the power board 54 assigned to the right cooking region 20*b*, a further circuit board is arranged forming a control electronics for the combination appliance 10.

Figure 4:
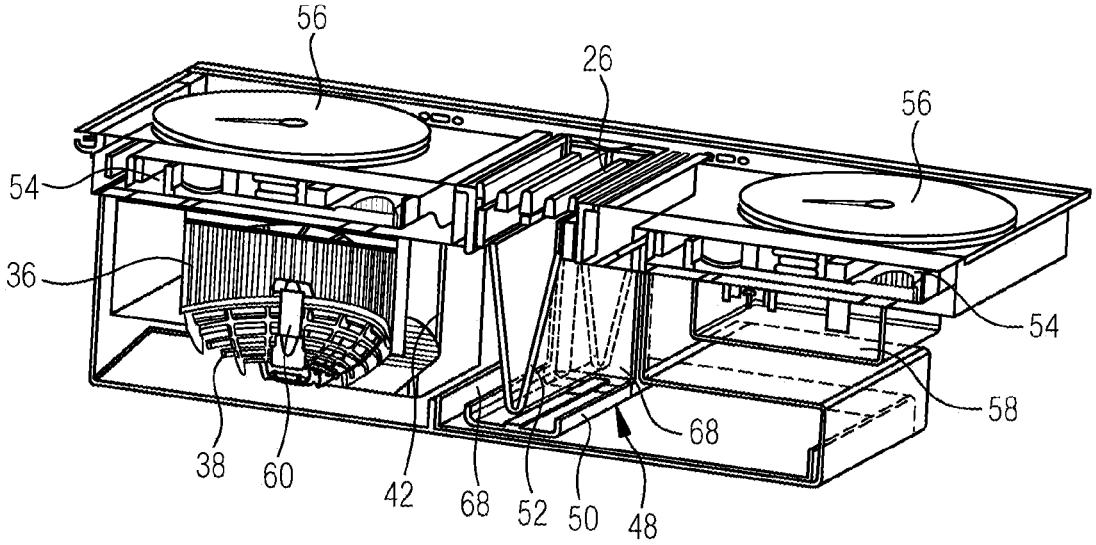
FIG. 4 is a combination appliance slightly different from that one of FIG. 2 with transparent worktop in a central cross-sectional view and from another perspective.

As can be seen from FIG. 4, which is also a cross-sectional illustration of the combination appliance 10, but with a section plane in a centre region (lengthwise related to the rectangular design of the cooking hob 12), the extraction fan 36 comprises a cylindrical fan propeller with a plurality of fan blades arranged along a cylinder shell surface, the fan propeller rotating around a vertical axis 60. In that, air is sucked in from below (intake opening 38) and blown out radially outwards, and leaving the fan housing 42 at the fan outlet 40, as already mentioned above. Further, a central cross-section through the filter assembly 48 is also provided by FIG. 4, which illustrates the arrangement of the filter 52 in the filter carrier 50.

Figure 5:
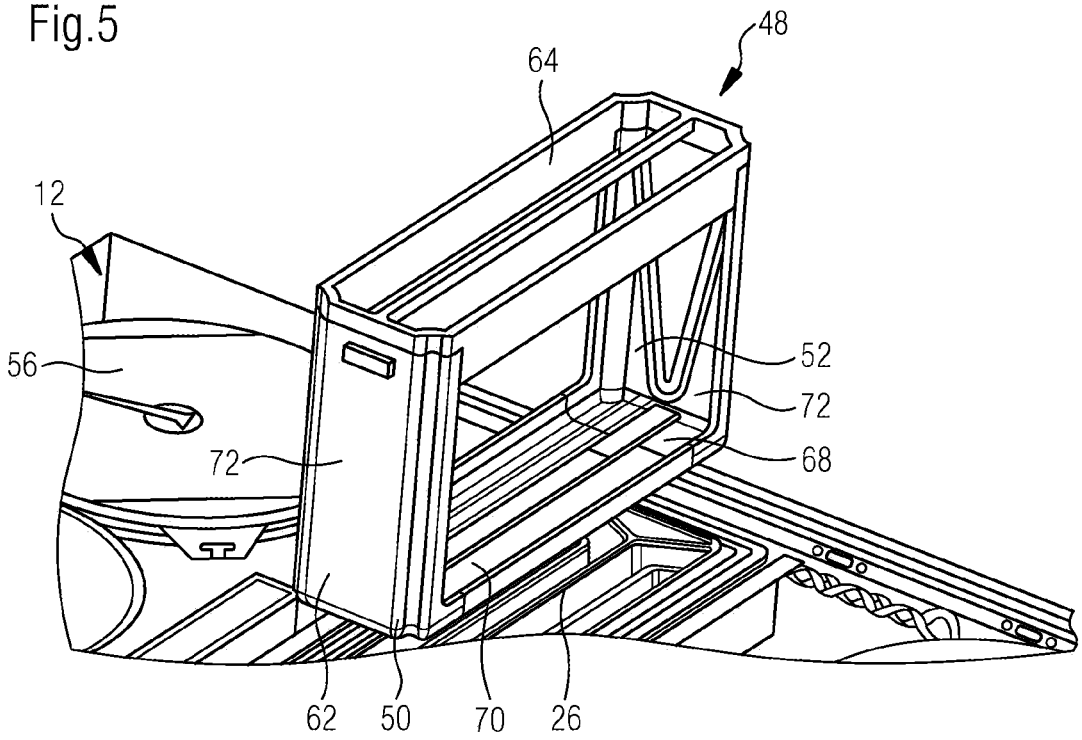
FIG. 5 is a filter carrier removed from the combination appliance of FIG. 4.

According to FIG. 5, the filter assembly 48 of FIG. 4 is removed from the suction opening 24 and illustrated in a raised position compared to the cooking hob 12. In order to remove the filter assembly 48, the cover grid 26 has to be removed prior to the removal of the filter assembly 48. This virtual state is not shown in the figures. Rather, according to FIG. 5, the cover grid 26 is illustrated in a position reinstated into the suction opening 24. The removed filter assembly 48, presented in FIG. 5 in its entirety and enlarged compared to FIG. 4, includes a V-shaped filter element 52 housed in the filter carrier 50 in a suspended position. The filter 52 of the embodiment according to FIGS. 4 and 5 is designed in one piece; i.e. the filter surface extends along the entire V-shaped area, including a rounded acute-angled bottom section thereof.

Figure 6:
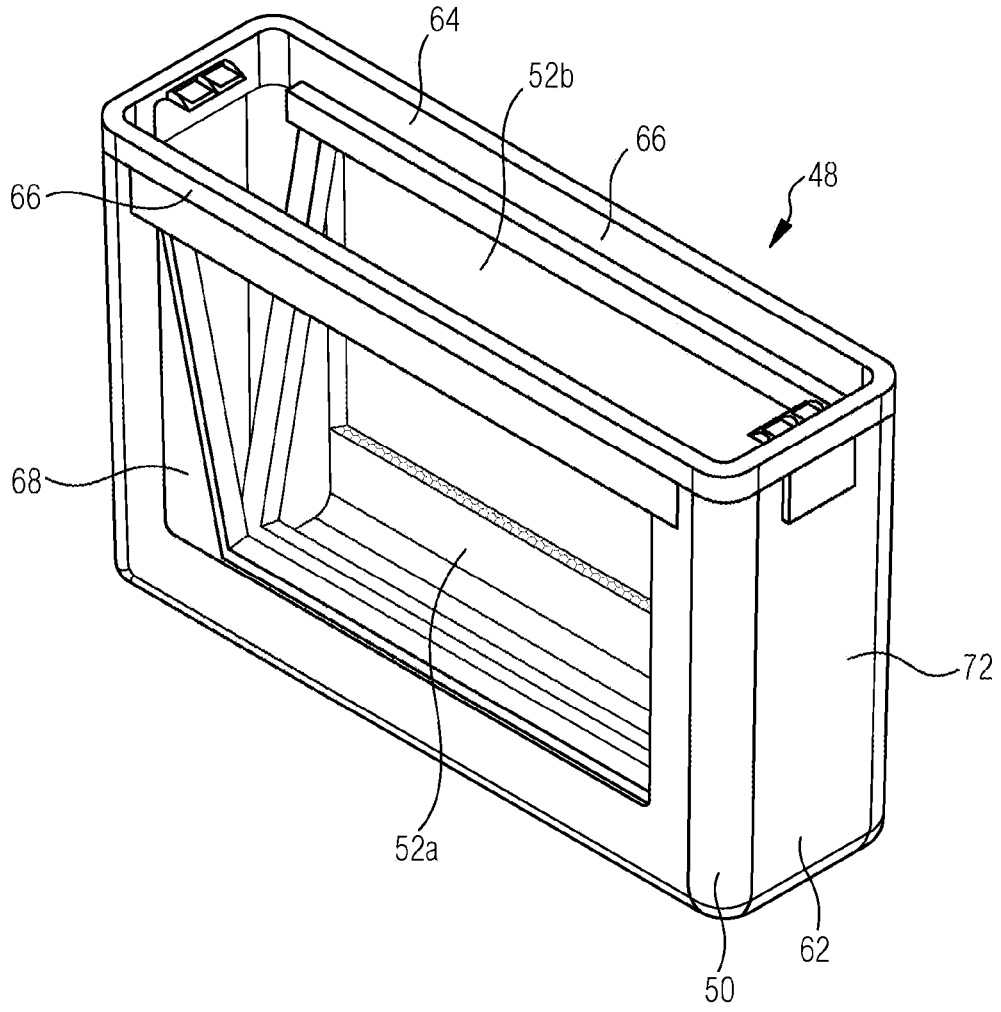
FIG. 6 is an individual depiction of a filter carrier similar to FIG. 5 with modified filter assembly.
Figure 7:
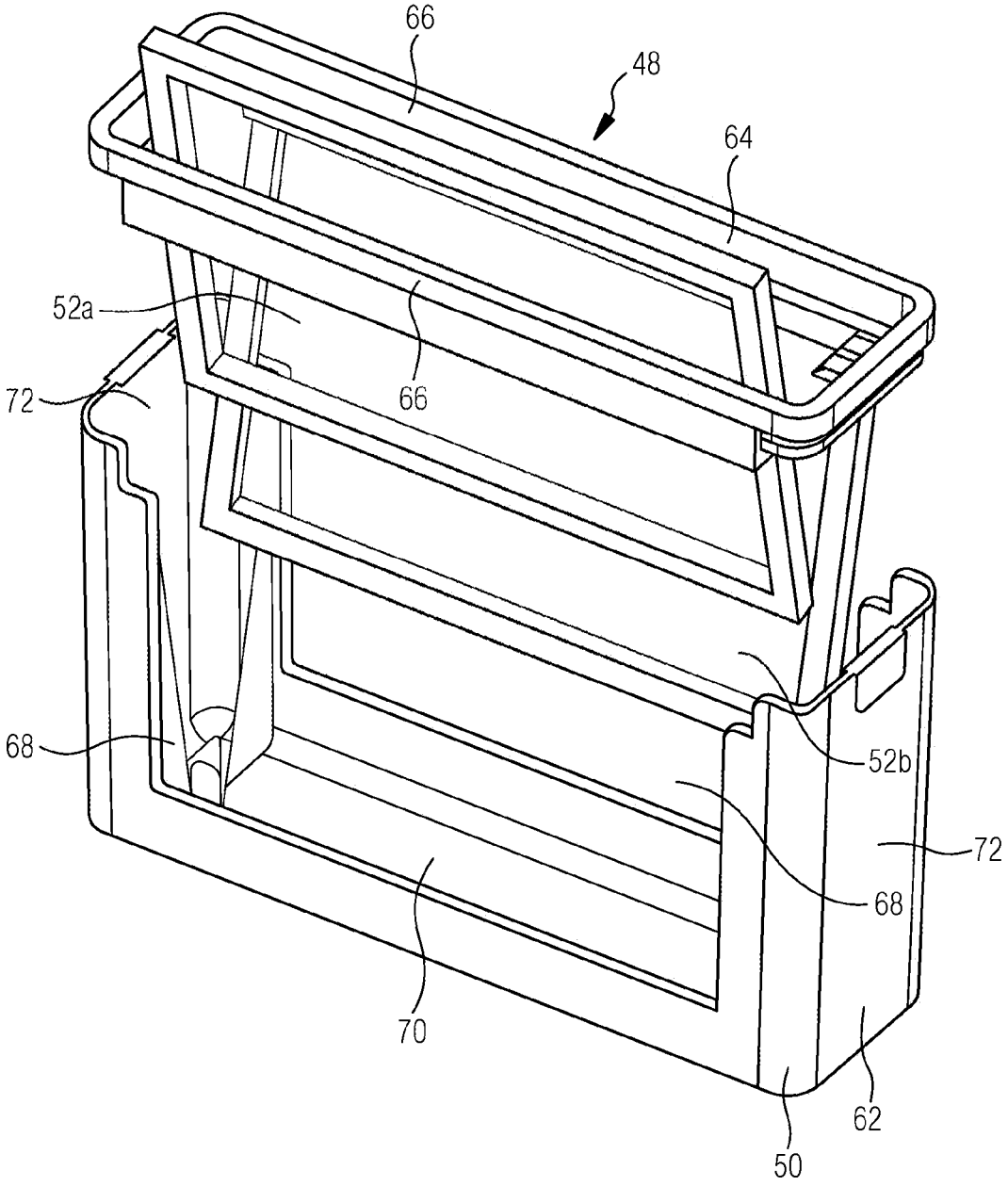
FIG. 7 is the filter assembly of FIG. 6 with lifted filter assembly.

Contrary to the above-described filter design according to FIGS. 4 and 5, the differently designed filter according to FIGS. 6 and 7 comprises two rectangular flat filter elements 52*a*, 52*b* arranged in inclined directions, in a way that, in the assembled state of the filter assembly 48 according to FIG. 6, they also form a V-shaped filter arrangement.

Both filter assembly embodiments, according to FIGS. 4, 5 and FIGS. 6, 7, are interchangeable, i.e. both solutions are equally suited for the combination appliance 10 according to the present invention.

As can be seen from FIGS. 5 and 7, not only the entire filter assembly 48 is removable from the suction opening 24, but also the filter 52, both the V-shaped filter 52 according to FIG. 5 and the two rectangular flat filter elements 52*a*, 52*b* according to FIGS. 6 and 7, are removable from the carrier housing 62, specifically for cleaning and/or replacing purposes.

FIG. 7 also shows the construction of the filter assembly 48 in more detail. As illustrated, the filter carrier 50 includes a carrier housing 62 and a carrier frame 64, which are separable from each other. In an assembled state, the carrier frame 64 forms an upper face of the filter carrier 50 and, in that, covers the open upper side of the carrier housing 62. Both types of filter arrangement, either the single-piece V-shaped filter 52 or the V-shaped arrangement of the two flat filter elements 52*a*, 52*b*, may be fixedly connected to the carrier frame 64. Preferably, however, as indicated by FIG. 7, either filter arrangement 52; 52*a*, 52*b* is also detachable from the carrier frame 64. In this respect, as is explained in the example using the embodiment pursuant to FIGS. 6 and 7, each one of the two flat filter elements 52*a*, 52*b* is detachably coupled to one of the longer frame parts 66, which are arranged in parallel to each other.

As shown in FIG. 2 by dotted arrows $\mathbf{46}^1$ and $\mathbf{46}^2$, the flow of cooking vapours is conducted from the suction opening 24 and the open top side of the V-shaped filter arrangement 52; 52*a*, 52*b* through the filter surface (mainly that one facing the extraction fan 36) before leaving the filter assembly 48 by penetrating the lateral surfaces 68 extending downwards from the longer frame parts 66. In order to provide an extensive passage for the airflow on its way out from the carrier housing 62, the lateral surfaces 68 are open to a great extent, which results in remaining merely a frame section of each lateral surface 68.

An entire filtering of the cooking vapours, i.e. without providing any non-filtering bypass for the cooking vapours, is received by the two different filter arrangements 52; 52*a*, 52*b* in different ways:

The single-piece V-shaped filter 52 provides an all-round filter surface, of course not including its open top side, but, instead, including its end surfaces, so that an airflow in all horizontal directions penetrates a filter surface;

the V-shaped arrangement of the two flat filter elements 52*a*, 52*b* only provide a filtering passage through the filter surfaces of the flat filter elements 52*a*, 52*b*. In order to prevent any non-filtering bypass, the bottom edges of the rectangular flat filter elements are supported by the inner surface of the bottom area 70 in a way as to provide a mostly sealed contact area against that part of the carrier housing 62. Further, the end surfaces of this type of filter arrangement, which are lacking a filter surface, are also sealed against the carrier housing 62, namely by way of the lateral edges of the flat filter elements 52*a*, 52*b* abutting against the inner surfaces of end walls 72 of the carrier housing 62, also in a way as to provide a mostly sealed contact area against these parts of the carrier housing 62.

Both above-described filter designs are washable, e.g. in a dishwasher. Also the carrier housing 62 is washable after having been separated from the carrier frame 64.

Moreover, in addition to its function of housing anyone of the filter arrangement 52; 52*a*, 52*b*, the carrier housing 62 also serves the purpose of collecting spilled liquids, which occur from time to time during cooking processes and which may flow into the suction opening 24 of the downdraft extraction device 14. In order to prevent any malfunction of any component, particularly any electrical component, of the combination appliance, specifically of the extraction device 14, the liquids entering the suction opening 24 are collected by the bottom area 70 of the carrier housing 62, which bottom area 70 is of a shell-like or tray-like construction. Liquids that have been collected therein have to be removed by emptying the bottom area 70. Also for that purpose the removability of the filter assembly 48 is necessary.

However, due to the extensively open lateral surfaces of the carrier housing 62, its bottom area 70 only provides a limited volume for the collection of liquid spillage, so that an extensive occurrence of liquid spillage may cause an overflow passing through the lateral surfaces 68, which, in turn, may cause malfunctions of the combination appliance, e.g. a short circuit at an electric component. Therefore, safety regulations regulate that a second collection device, which is independent from the first collection device provided by the bottom area 70 of the carrier housing 62, shall be additionally included in the combination appliance 10. Said second collection device shall be configured to receive or to handle liquid spillage overflowing from the first collection device, providing an additional, preferably an even more enlarged, volume for the collection of liquid spillage. The present invention provides different examples of such second collection devices, which will be explained as follows.

A first example of said second collection device is illustrated in FIG. 2. Directly beneath the filter carrier 50, a tray-like shell 74 is positioned in a way as to receive liquid overflowing from the bottom area 70 of the carrier housing 62 and dripping down therefrom. In order to ensure that the entire overflowing liquid will be taken up by the shell 74, its receiving area extends the bottom area 70 in all horizontal directions. The shell is fixed to the bottom of the casing 28, particularly by screws.

According to a second example of the second collection device, the shell 74 forms a liquid receiving part of a drawer 76. Said drawer 76 is movably arranged at the bottom of the casing 28.

Figure 9:
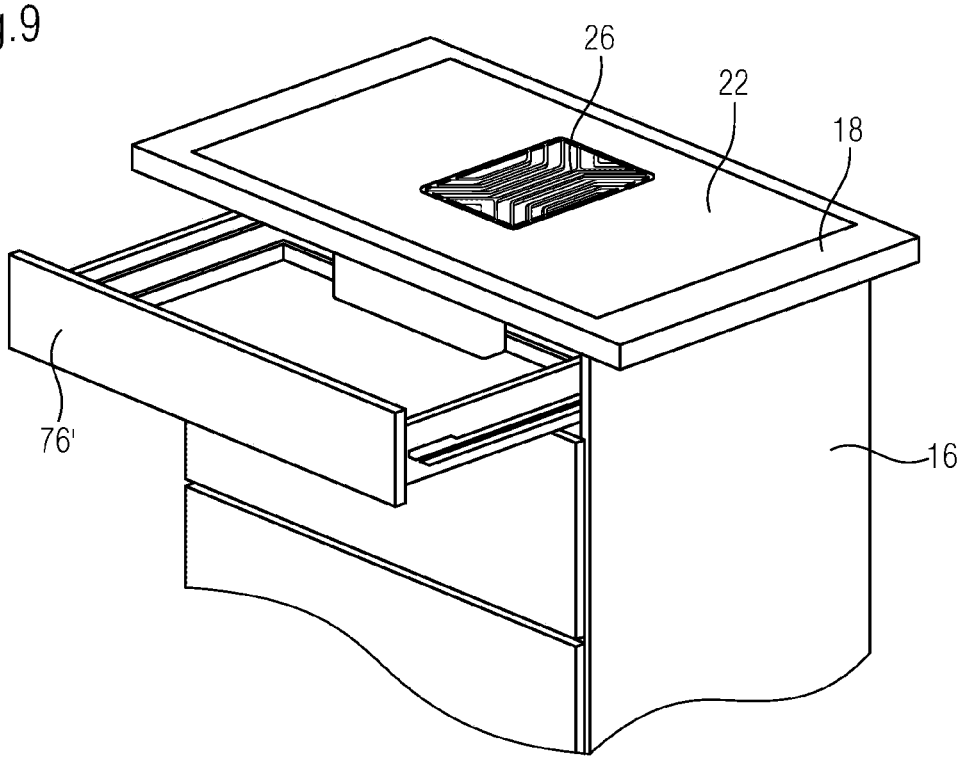
FIG. 9 is a schematic perspective view of a combination appliance similar to FIG. 8 installed in a kitchen cabinet and including a third example of the second collection device.

Also FIG. 9 shows (only schematically) a drawer solution for the second collection device, according to a third example. This solution is characterized by a drawer 76' movably arranged at the kitchen cabinet 16. The drawer 76' can be pulled out from the kitchen cabinet 16 in common way. Due to the fact that the drawer 76' extends over the entire width of the combination appliance 10, the volume for the collection of liquid spillage overflowing from the first collection device is comparably high.

Figure 10:
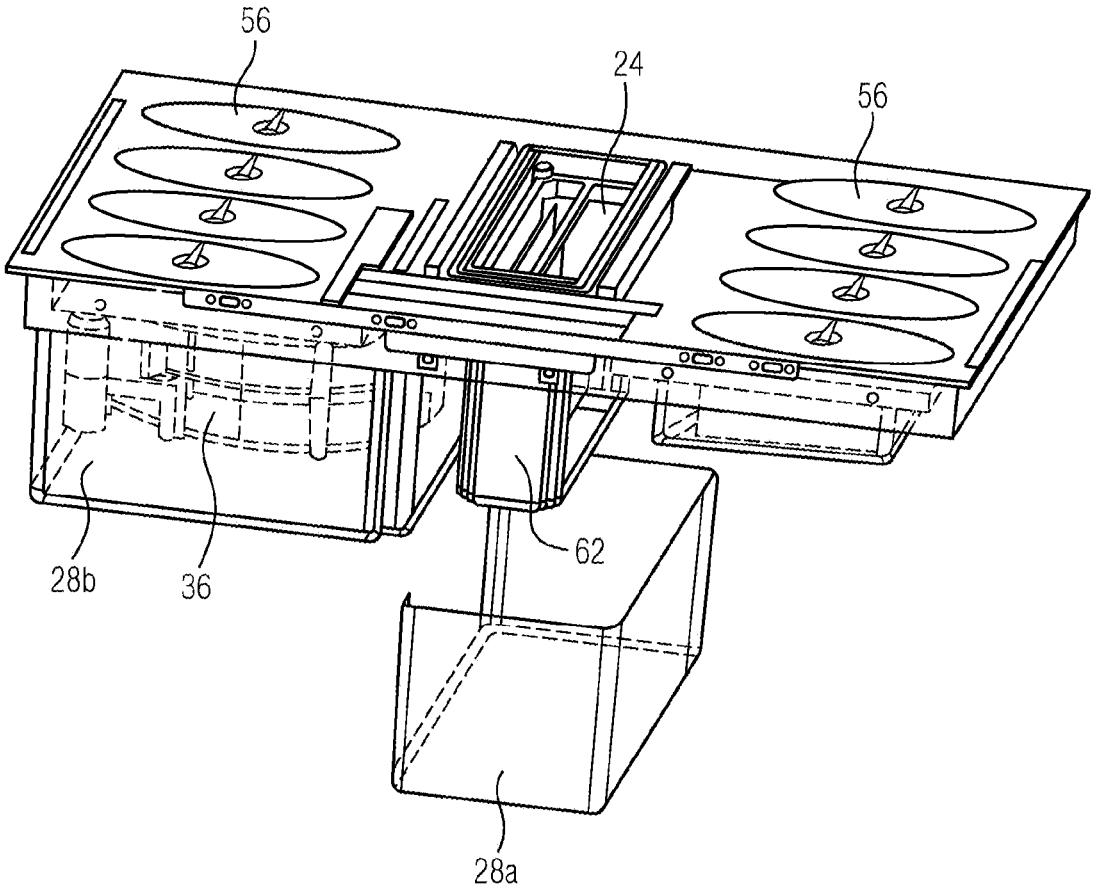
FIG. 10 is a perspective view of a combination appliance similar to FIG. 4 including a fourth example of the second collection device.

A fourth example of the second collection device is illustrated by FIG. 10. According to this embodiment, the casing 28 of the extraction device 14 is designed by a combination of a first casing part 28*a* and a second casing part 28*b*. While the second casing part, which is fixedly attached to a bottom of the cooking hob 12, encloses the extraction fan 36, the filter assembly 48 with its carrier housing 62 is completely included in the first casing part 28*a*. Said first casing part 28*a* is removably attached to the bottom of the cooking hob 12. In the assembled state of the first casing part 28*a*, the first and second casing parts 28*a*, 28*b* provide an airtight entire casing 28. The bottom of the first casing part 28*a* provides a second collection device in a similar way as the tray-like shell 74 of the first example above. To this end, the open side facing the second casing part 28*a* comprises a raised edge at its bottom.

Figure 8:
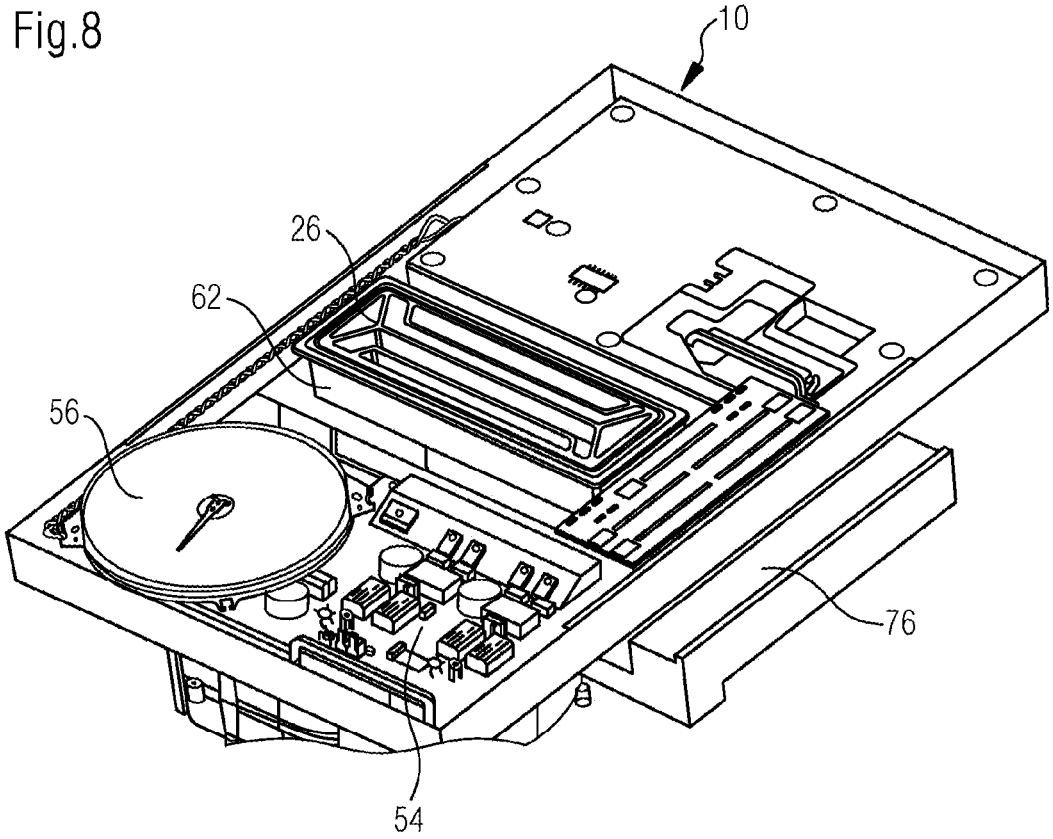
FIG. 8 is a perspective view of a combination appliance similar to FIG. 4 including a second example of the second collection device for spilled liquids.
Figure 11:
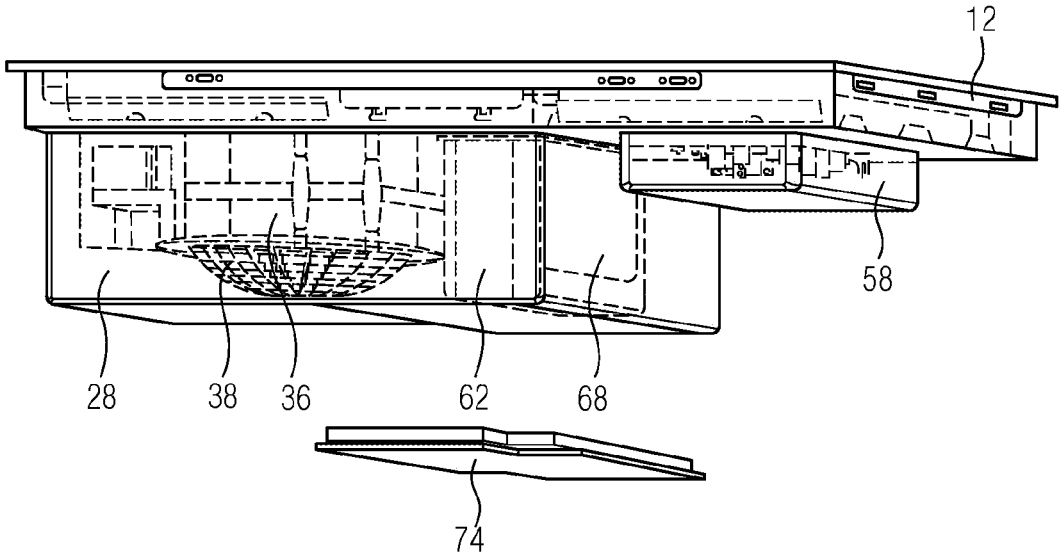
FIG. 11 is the combination appliance of FIG. 2 in a perspective from below with downwards removed first collection device.

In the situation of an overflow of liquid from the first collection device, i.e. from the bottom area 70 of the carrier housing 62, any of the above-described second collection devices 74, 76, 76' needs to be emptied. The drawer solutions of second and third examples according to FIGS. 8 and 9 can be emptied by removing the drawer 76, 76' from their related drawer runners, arranged either directly at the bottom of the casing 28 (FIG. 8) or at the kitchen cabinet (FIG. 9). The solutions with a tray-like shell 74 according to first and fourth examples can be emptied only by releasing the removable parts 74, 28*a*, in particular by unscrewing fixation screw, and removing them in a downwards movement as indicated in FIGS. 10 and 11.

Sensor means (not shown) may be arranged in the combination appliance 10, which sensor means may be adapted to detect a fill level in at least one of the first and second collection devices. Additionally or alternatively, the sensor means may be adapted to detect pollutions in at least one of the first and second collection devices. Said sensor means may be selected from anyone of the known solutions including reed switches or laser sensor means.

Figure 12:
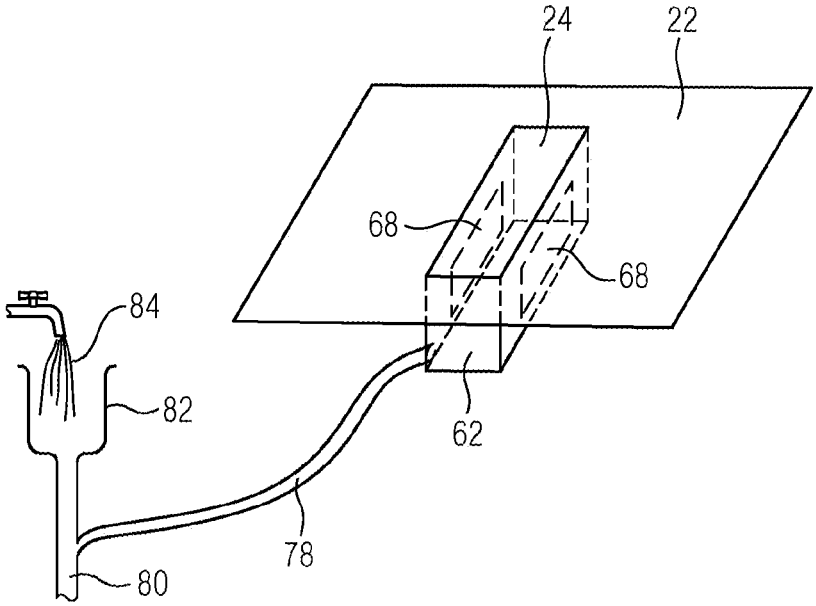
FIG. 12 is a schematic illustration of a combination appliance with a fifth example for the second collection device.

Finally, a fifth example of a second collection device is schematically illustrated by FIG. 12. Contrary to the above-described first to fourth examples, this solution does not comprise any kind of collection container. In fact, the liquid spillage collected in the bottom area 70 of the carrier housing 62 is drained off via a drain hose 78, which is connected to a drainpipe 80 of a kitchen sink for a direct removal of the liquid spillage after receiving a pre-defined fill level, which is significantly below an overflow level defined by the lower edge of the lateral surface 68 of the carrier housing 62. The evacuation of the liquid inside of the carrier housing 62 may be enforced by flow of drained water 84 causing a negative pressure to the inner volume of the drain hose 78 when running through the drainpipe 80, hence, making use of a Venturi effect.

Figure 13:
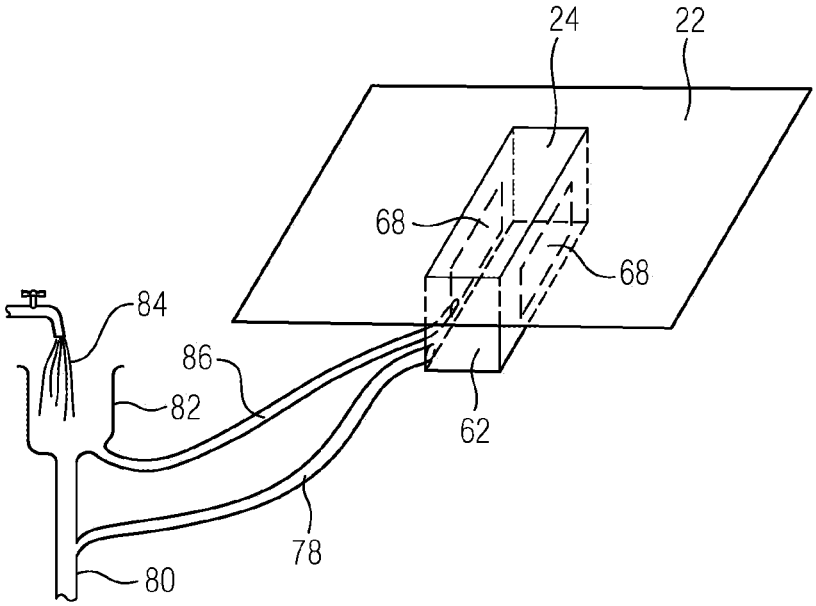
FIG. 13 is the combination appliance of FIG. 12 with a modification of the fifth example for the second collection device.

Due to the connection of a drain hose 78 for this fifth example, a removal of the carrier housing for cleaning purposes through the suction opening 24 may be difficult. Therefore, in order to perform such cleaning, the fifth example may be modified by an additional hose as illustrated by FIG. 13, which additional hose is a supply hose 84. Said supply hose can be flooded with fresh water from time to time in order to clean the carrier housing 62, in particular its bottom area 70. To this end, a first end of said supply hose 86 is connected to the kitchen sink 82 for receiving fresh water on demand, wherein a closing valve (not shown) may be arranged at said first end of the supply hose 86. The second end of the supply hose 86 is connected to the lateral surface 68 of the carrier housing 62 close to the overflow edge defined by the lower edge of the opening in the lateral surface 68.

Although illustrative embodiments of the present invention have been described herein with reference to the accompanying drawings, it is to be understood that the present invention is not limited to these precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 combination appliance
12 cooking hob
14 downdraft extraction device
16 kitchen cabinet
18 kitchen countertop
20*a*,20*b* cooking regions
22 worktop
24 suction opening
26 cover grid
28 casing
28*a*,28*b* first and second casing parts
30 exhaust opening
32 base area
34 outlet grille
36 extraction fan
38 intake opening
40 fan outlet
42 fan housing
44 air duct
46$^{1\ to\ 5}$ arrows indicating air flow
48 filter assembly
50 filter carrier
52 filter
52*a*,52*b* flat filter elements
54 power boards
56 induction coils
58 control electronics
60 vertical axis
62 carrier housing
64 carrier frame
66 longer frame parts
68 lateral surfaces
70 bottom area
72 end walls
74 shell
76,76' drawer
78 drain hose
80 drainpipe
82 kitchen sink
84 drained water
86 supply hose

The invention claimed is:

1. A combination appliance comprising:

a cooking hob, which comprises a cover plate or worktop having an opening or a recess formed therein, and a lid or grid inserted in the opening or recess, wherein said lid or grid is removable or pivotable; and an extraction device arranged below the cover plate or worktop, wherein the extraction device comprises:

a fan for sucking air from an area above the cooking hob through the opening or recess of the cover plate or worktop, a filter carrier arranged directly beneath said opening or recess and comprising a carrier housing, wherein a bottom area of said carrier housing is a first liquid collector configured as a basin adapted to collect liquid spillage that passes through the opening or recess in said cover plate or worktop, a filter that is installed within the filter carrier and adapted to filter particulates and/or droplets that pass through the opening or recess, a casing that encloses the fan, filter carrier, and filter, and a second liquid collector adapted to collect liquid spillage from said basin once a capacity of said basin has been reached, wherein the basin of the filter carrier is directly under the filter, wherein the second liquid collector is:

a drawer being disposed directly under the carrier housing in a closed position of the drawer, said drawer being openable by pulling away from the casing of the extraction device to provide access thereto for removing liquid collected therein.

2. The combination appliance according to claim 1, wherein the filter includes two plain filter elements arranged in parallel to each other or arranged in a V-shaped alignment.

3. The combination appliance according to claim 1, wherein a separation element is arranged in the opening or recess of the cover plate or worktop and separates components of the cooking hob from components of the extraction device, wherein the separation element has at least two holding or support elements for holding or supporting the lid or grid.

4. The combination appliance according to claim 1, wherein the second liquid collector is arranged downstream of the first liquid collector, facilitating a liquid flow from the first liquid collector to the second liquid collector, said second liquid collector being removable from the combination appliance in a movement direction away from the first liquid collector.

5. The combination appliance according to claim 1, further comprising:

a locking system, which prevents the drawer from being opened during an operation of the extraction device and/or of the cooking hob, and/or a sensor or switching element, which is coupled with the drawer effecting a switch off of the extraction device and/or of the cooking hob, when the drawer is not completely closed.

6. The combination appliance according to claim 1, wherein at least one sensor selected from among a liquid sensor, a dirt sensor, a weight sensor, a detection sensor and a filling level sensor, is in operative connection with the first liquid collector or second liquid collector, the at least one sensor being arranged in or at the first liquid collector or second liquid collector.

7. The combination appliance according to claim 6, further comprising a signalling means for generating a visual and/or an acoustic signal depending on a signal provided by the at least one sensor.

8. The combination appliance according to claim 1, wherein at least one illumination element is arranged in or at the first liquid collector or second liquid collector.

9. The combination appliance according to claim 1, wherein at least one component of the extraction device comprises or is coated by an anti-bacterial material.

10. The combination appliance according to claim 1, wherein:

the lid or grid is configured to inhibit passage of objects through said opening or recess;

the filter is suspended above the bottom area of the carrier housing, said filter being adapted to accommodate passage of air therethrough; and the fan has a downward-facing intake, said fan being configured to draw air from an area above the cover plate or worktop, through the opening or recess therein, then through the filter, and into an exhaust duct for recirculation of the drawn air back into a room space housing the combination appliance via an exhaust opening.

11. The combination appliance according to claim 10, wherein the drawer is disposed beneath and extends laterally beyond said basin in all directions.

12. The combination appliance according to claim 11, said filter carrier being removable from said combination appliance through said opening or recess when said lid or grid is removed therefrom, said filter being removable from said filter carrier.

13. The combination appliance according to claim 1, wherein the drawer is directly under the opening or recess of the cover plate or worktop in the closed position of the drawer.

14. The combination appliance according to claim 1, wherein:

the carrier housing of the filter carrier defines an overflow opening adapted such that liquid spillage overflowing from said basin passes through the overflow opening of the carrier housing and is collected in the second liquid collector, and said fan is configured to draw air through the opening or recess of the cover plate or worktop, then through the filter, and then through the overflow opening of the carrier housing.

* * * * *